US006467736B1

(12) United States Patent
Chiang

(10) Patent No.: US 6,467,736 B1
(45) Date of Patent: Oct. 22, 2002

(54) DEVICE FOR HOLDING A NURSING BOTTLE

(76) Inventor: Jenchieh Chiang, No. 182, Cheng Yi Road, Jen Te Hsiang, Tainan Hsian (TW)

( * ) Notice: Subject to any disclaimer, the term of this patent is extended or adjusted under 35 U.S.C. 154(b) by 0 days.

(21) Appl. No.: 09/977,178

(22) Filed: Oct. 15, 2001

(51) Int. Cl.[7] ..... A61J 9/06
(52) U.S. Cl. ..... 248/102; 248/311.2
(58) Field of Search ..... 248/102, 104, 248/309.1, 311.2

(56) References Cited

U.S. PATENT DOCUMENTS 2,673,705 A * 3/1954 Buckley ..... 248/317
3,144,230 A * 8/1964 Brooks ..... 248/102
4,463,859 A * 8/1984 Greene ..... 215/11 R
4,513,935 A * 4/1985 Aquirre ..... 248/105
5,217,192 A * 6/1993 Oktayuren ..... 248/102
5,873,551 A * 2/1999 Jones ..... 248/102
6,000,664 A * 12/1999 Hood ..... 248/102

* cited by examiner

*Primary Examiner*—Anita King
*Assistant Examiner*—A. Joseph Wujciak, III
(74) *Attorney, Agent, or Firm*—Charles E. Baxley

(57) ABSTRACT

A device for holding a nursing bottle comprises a main body attached to a support and two suspension devices mounted to the main body. Each suspension device comprises a holding member. The holding members respectively hold a front end and a rear end of a nursing bottle. A level and an inclination of the nursing bottle can be adjusted.

3 Claims, 8 Drawing Sheets

DEVICE FOR HOLDING A NURSING BOTTLE

BACKGROUND OF THE INVENTION

1. Field of the Invention

The present invention relates to a device for holding a nursing bottle to save labor when feeding a baby in a bed, stroller, or any other place. The device allows adjustment in a level and an inclination angular position of the nursing bottle and supports the nursing bottle stably.

2. Description of the Related Art

Nursing bottles are commonly used to feed babies. However, the adult must be patient to hold the nursing bottle when feeding a baby that is still to small to hold the nursing bottle. It is, of course, a waste of time to the adult. Another problem is encountered when the baby in a moving stroller is hungry. The adult must stop the stroller to feed the baby, which also wastes time.

SUMMARY OF THE INVENTION

An object of the present invention is to provide a device for holding a nursing bottle to feed a baby in a bed, stroller, or other places, thereby eliminating the inconvenience to the adult during feeding. The device may reliably hold the nursing bottle to feed the baby, and the adult may do some other things to avoid waste of time.

A device for holding a nursing bottle in accordance with the present invention comprises a main body attached to a support and two suspension means mounted to the main body. Each suspension means comprises a holding member. The holding members respectively hold a front end and a rear end of a nursing bottle.

Each suspension means comprises a casing, a bobbin rotatably mounted in the casing, and a coil member wound around the bobbin and having an end extending out of the casing. The end of the coil member is engaged with an associated one of the holding members. Each suspension means further comprises a stop for allowing outward movement of the coil member when the stop is in a position and allowing retraction of the coil member into the casing when the stop is in another position, thereby allowing adjustment in a level and an inclination of the nursing bottle held by the holding members by means of controlling the stop of each suspension means.

The stop of each suspension means comprises a button and a press end and is mounted to a side of the casing, the button being controllable to urge the press end to press against the coil member to thereby retain the coil member in place, further comprising means for retracting the coil member into the casing when the stop is released.

A music device may be attached to the main body.

In an embedment of the invention, the main body comprises a first notch and a second notch in each of two sides thereof. The first notch of each side of the main body allows manual operation to the stop of an associated suspension means. The second notch of each side of the main body allows passage of the coil member of an associated suspension means.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
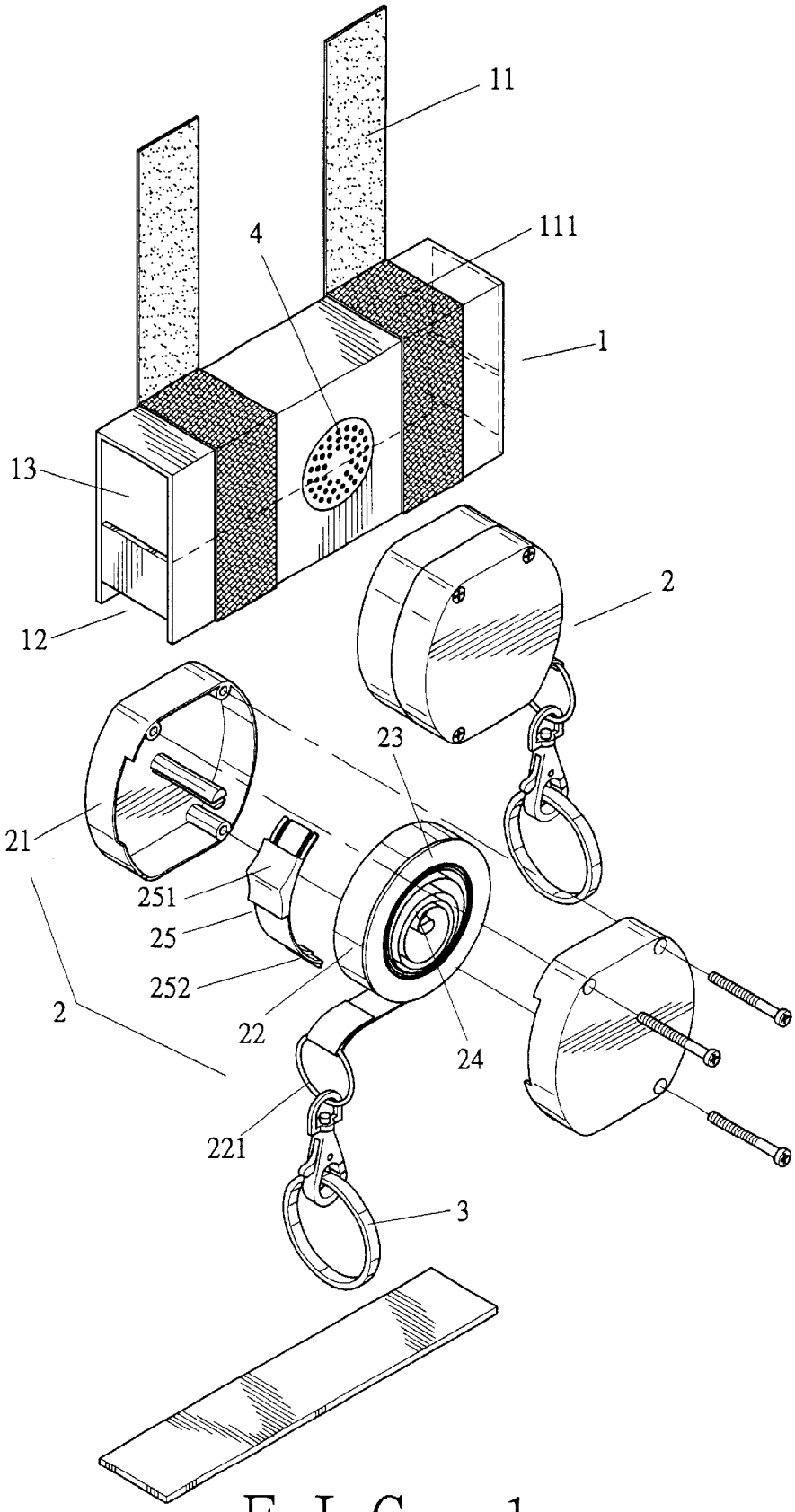
FIG. 1 is an exploded perspective view of a device for holding a nursing bottle in accordance with the present invention.
Figure 2:
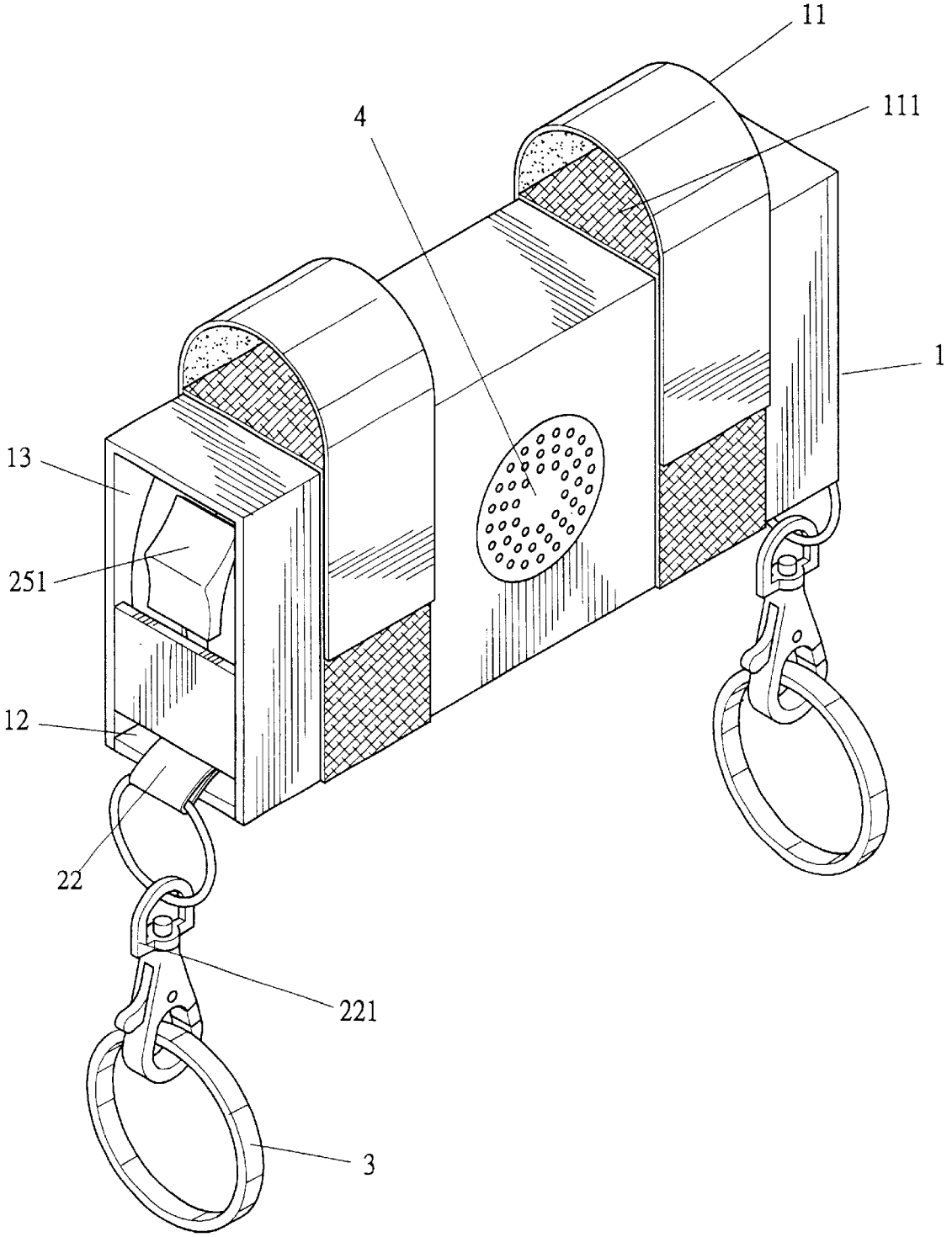
FIG. 2 is a perspective view of the device for holding a nursing bottle in accordance with the present invention.
Figure 3:
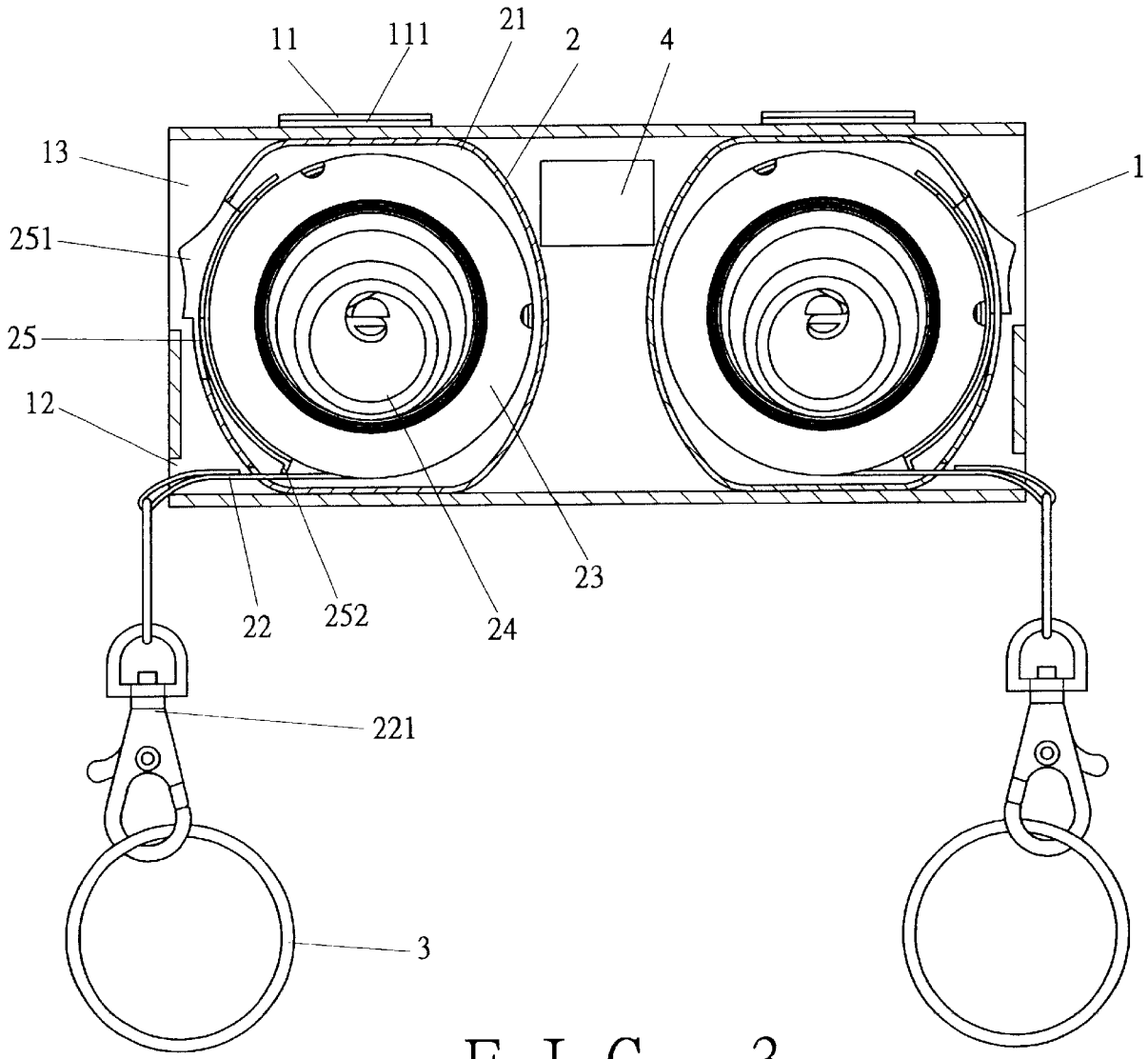
FIG. 3 is a side view, partly sectioned, of the device for holding a nursing bottle in accordance with the present invention.

Referring to FIGS. 1 through 3, a device for holding a nursing bottle in accordance with the present invention generally comprises a main body 1 and two suspension means 2. The main body 1 comprises means 11 for attachment to an object, such as a rod, bracket, or other support. In this embodiment, the attaching means 11 comprises two hook and loop fasteners 111 to allow easy engagement and detachment. The suspension means 2 are mounted inside the main body 1. The main body 1 further comprises two notches 12 and 13 in each of two sides thereof, which will be described later.

Each suspension means 2 comprises a casing 21, a coil member 22, a bobbin 23, an elastic element 24, and a stop 25. The coil member 22 has an appropriate length and is wound around the bobbin 23 with an end of the coil member 22 extending out of the casing. 21 via the notch 12 of the main body 1 (FIG. 3). The coil member 22 further includes a holding ring 3 attached to the end thereof. The bobbin 23 is rotatably mounted in the casing 3 and biased by the elastic element 24 in a manner that the elastic element 24 is twisted when the bobbin 23 is turned for outward movement of the coil member 22, thereby storing a returning force. The stop 25 comprises a button 251 and a press end 252 and is mounted to a side of the casing 21. The button 251 can be controlled via the notch 13 of the main body 1 to press the press end 252 against the coil member 22 and thus retain the coil member 22 in place when the coil member 22 is pulled outward to a desired length. The holding member 3 is attached to a ring 221, which, in turn, is attached to the outer end of the coil member 22. The holding member 3 is made of flexible material for properly clamping a nursing bottle.

Figure 4A:
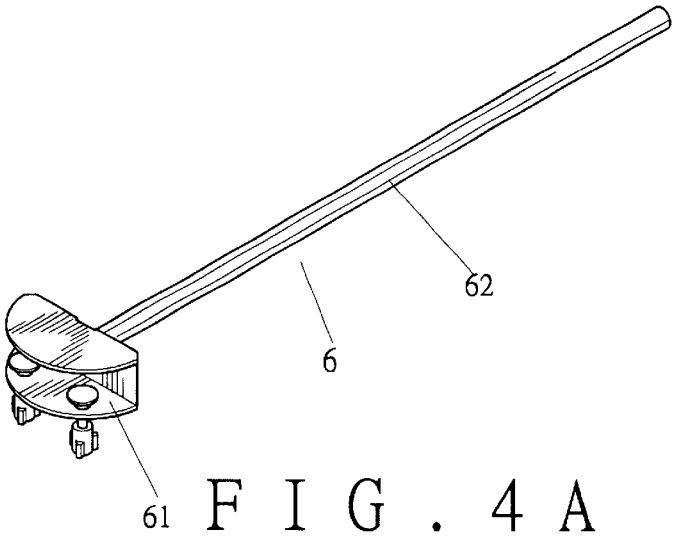
FIG. 4A is a perspective view of another embodiment of the support assembly for supporting the device for holding a nursing bottle.
Figure 4:
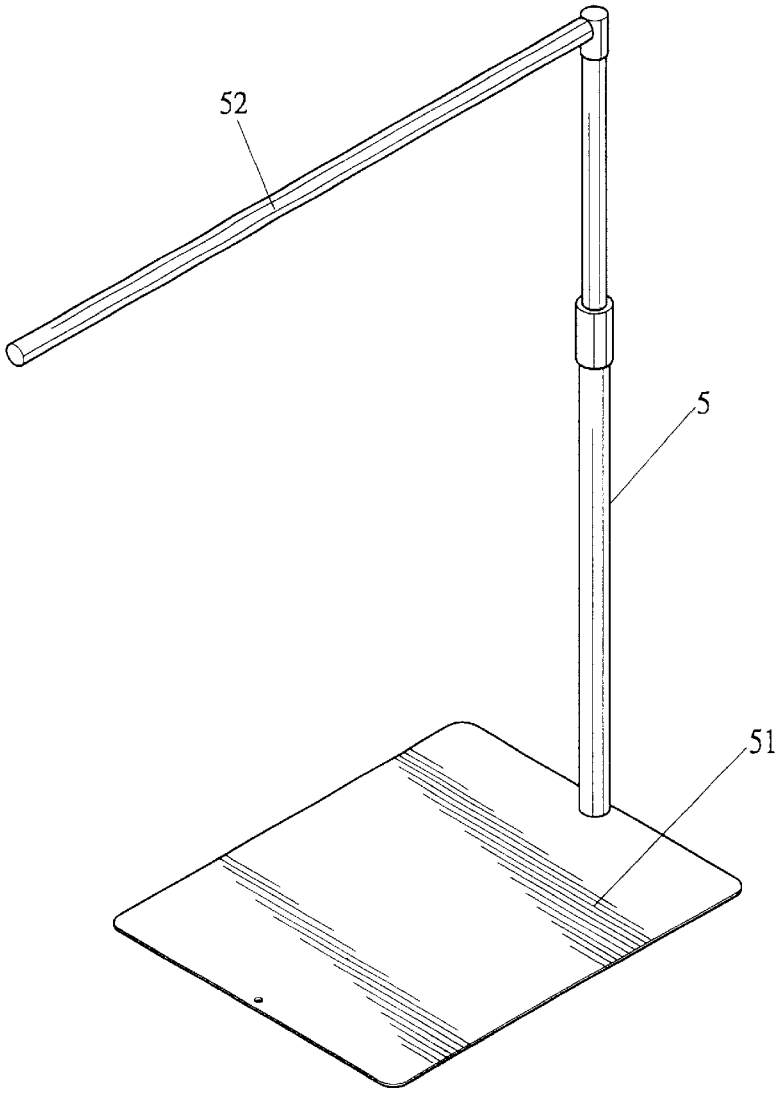
FIG. 4 is a perspective view, partly exploded, illustrating a support assembly to which the device for holding a nursing bottle is attached.

Referring to FIG. 4, when in use, the device for holding a nursing bottle in accordance with the present invention may be used with a support assembly comprising a base 51, a post 5 extending upright from the base 51, and a support rod 52 attached to an upper end of the post 5 and extending along a direction parallel to the ground. FIG. 4A illustrates another embodiment of the support assembly 6 comprising a support arm 62 and an engaging section 61 at an end of the support arm 62.

Figure 5:
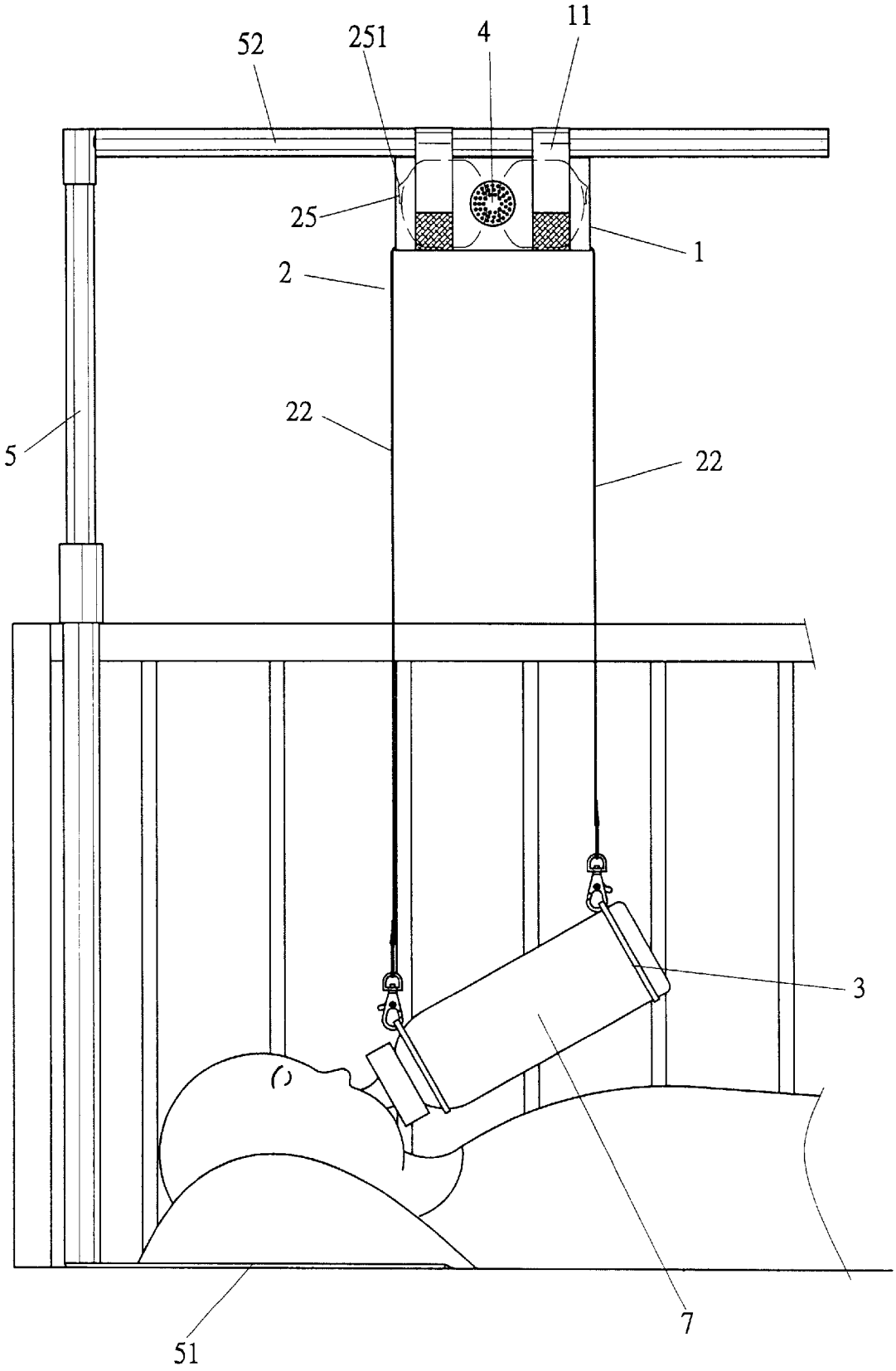
FIG. 5 is a schematic side view illustrating use of the device for holding a nursing bottle and the support assembly with a bed.

Referring to FIG. 5, the support assembly 5, 51, 52 is attached to a bed for a baby, and the device for holding a nursing bottle is attached to the support rod 52 by the hook and loop fasteners 11. Then, front and rear ends of a nursing bottle 7 are suspended by the holding members 3. Next, each stop 25 is released to allow each coil member 22 to be pulled out of the respective casing 21 under the action of gravity, and the respective button 251 is pushed or moved to a position to stop further outward movement of the respective coil member 22, thereby retaining the nursing bottle 7 at a desired level and in a desired inclination, best shown in FIG. 5. Thus, after putting the nipple (not labeled) of the nursing bottle 7 into the baby's mouth, an adult may activate a music device 4 that can be attached to the main body 4 or any appropriate location. Thus, the adult does not have to hold the nursing bottle 7 during feeding to save labor and time. After feeding, the button 251 of one of the suspension means 2 is pushed to lift the associated coil member 22 under the action of the returning force provided by the associated elastic element 24. Thus, the nipple of the nursing bottle 7 will be moved out of the baby's mouth, best shown in FIG. 6.

Figure 6:
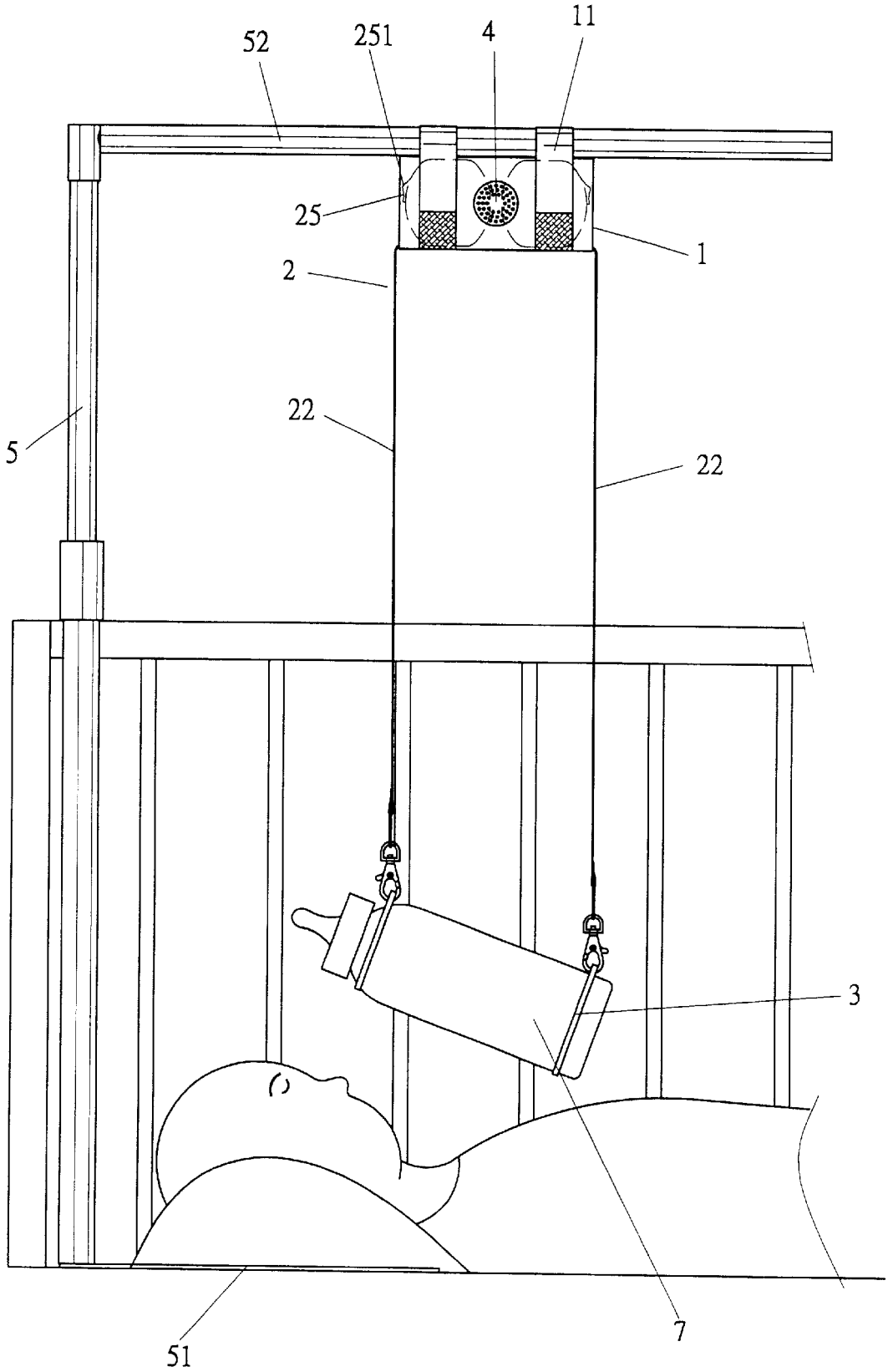
FIG. 6 is a side view similar to FIG. 5, wherein the level of the nursing bottle is adjusted after finish of feeding.
Figure 7:
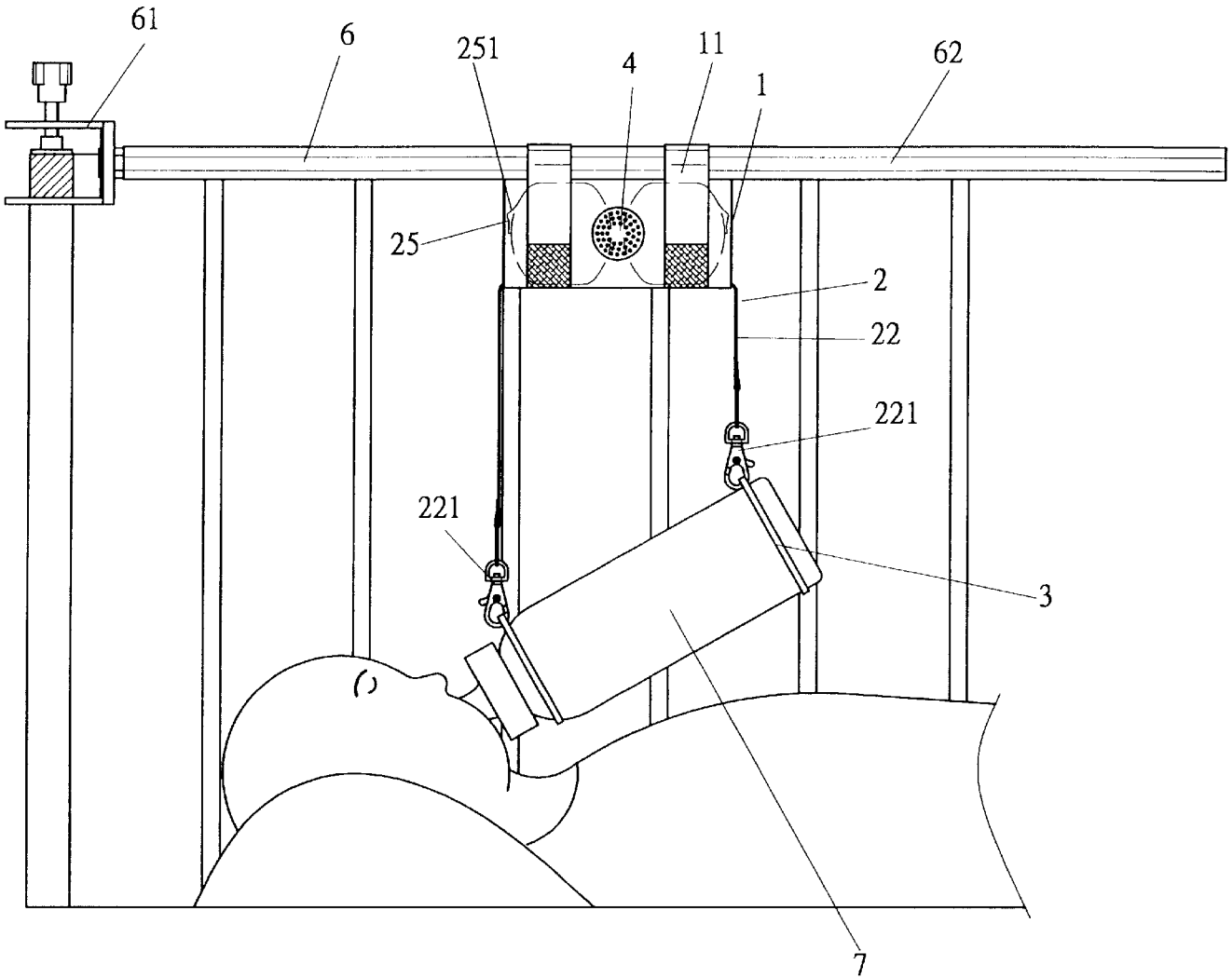
FIG. 7 is a schematic side view illustrating a modified embodiment of the invention.
Figure 8:
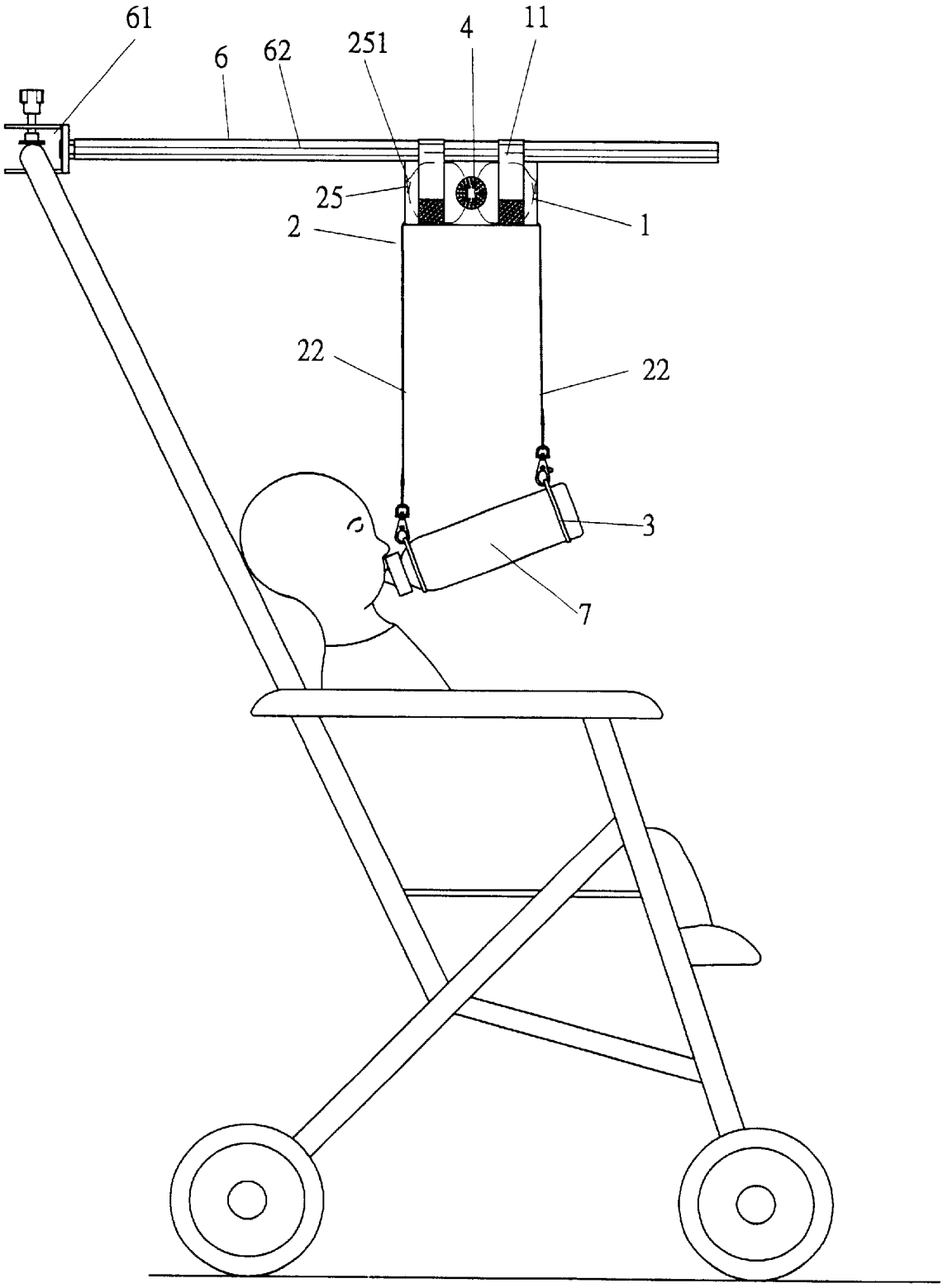
FIG. 8 is a schematic side view illustrating use of the nursing bottle in a stroller.

FIG. 7 illustrates a modified embodiment, wherein the support assembly 6 is used to replace the support assembly 51, 5, 52 in the embodiment shown in FIGS. 5 and 6. The engaging section 61 of the support assembly 6 is attached to a frame (not labeled) of the bed (not labeled) to thereby support the support rod 62 at a level higher than the baby. FIG. 8 illustrates attachment of the support assembly 6 to a stroller for subsequent attachment of the device for holding a nursing bottle to the support rod 62 of the support assembly 6. Thus, even the stroller is moving, the baby can be fed without stopping the stroller.

According to the above description, it is appreciated that the main body 1 of the device for holding a nursing bottle in accordance with the present invention can be easily attached to a bed, stroller, or any other suitable object to thereby eliminate inconvenience of feeding of a baby and to thereby save time. The coil members 22 in accordance with the present invention can be adjusted to desired lengths and can thus be used with beds and strollers of different heights. In addition, the holding members 3 respectively attached to the outer ends of the coil members 22 simultaneously engage with two ends of the nursing bottle 7, which reliably holds the nursing bottle 7 at a desired level while allowing adjustment in an inclination of the nursing bottle 7. Further, when feeding is not required, the nipple of the nursing bottle is lifted upward by means of lifting one of the coil members 22, which is convenient to operate. Further, the coil members 22 can be retracted into the main body 1 when not in use, which is convenient to storage.

Although the invention has been explained in relation to its preferred embodiment, it is to be understood that many other possible modifications and variations can be made without departing from the scope of the invention as hereinafter claimed.

What is claimed is:

1. An apparatus for holding a nursing bottle and comprising:

a main body adapted to be attached to a support;

two suspension means mounted to the main body, each of the suspension means comprising a holding member, the holding members respectively holding a front end and a rear end of a nursing bottle, each of the suspension means comprising a casing, a bobbin rotatably mounted in the casing, and a coil member wound around the bobbin and having an end extending out of the casing, the end of the coil member being engaged with an associated one of the holding members;

each of the suspension means further comprising a stop for allowing outward movement of the coil member when the stop is in a position and allowing retraction of the coil member into the casing when the stop is in another position, thereby allowing adjustment in a level and an inclination of the nursing bottle held by the holding members by means of controlling the stop of each of the suspension means.

2. The apparatus for holding a nursing bottle as claimed in claim 1, wherein the stop of each of the suspension means comprises a button and a press end and is mounted to a side of the casing, the button being controllable to urge the press end to press against the coil member thereby to retain the coil member in place, further comprising means for retracting the coil member into the casing when the stop is released.

3. The apparatus for holding a nursing bottle as claimed in claim 1, wherein the main body comprises a first notch and a second notch in each of the two sides thereof, the first notch of each of the sides of the main body allowing manual operation to the stop of an associated one of the suspension means, the second notch of each of the sides of the main body allowing passage of the coil member of an associated one of the suspension means.

* * * * *